US010284954B2

(12) United States Patent
Einaudi et al.

(10) Patent No.: US 10,284,954 B2
(45) Date of Patent: May 7, 2019

(54) LOUDSPEAKER WITH OPTIONAL EXTENDER FOR PRODUCTION OF HIGH-FREQUENCY AUDIO

(71) Applicant: Caavo Inc, Santa Clara, CA (US)

(72) Inventors: Andrew E. Einaudi, San Francisco, CA (US); Ashish D. Aggarwal, Stevenson Ranch, CA (US)

(73) Assignee: Caavo Inc, Milpitas, CA (US)

( * ) Notice: Subject to any disclaimer, the term of this patent is extended or adjusted under 35 U.S.C. 154(b) by 0 days.

(21) Appl. No.: 15/398,639

(22) Filed: Jan. 4, 2017

(65) Prior Publication Data

US 2017/0195792 A1 Jul. 6, 2017

Related U.S. Application Data

(60) Provisional application No. 62/274,906, filed on Jan. 5, 2016.

(51) Int. Cl.

| | |
|---|---|
| ***H04R 3/14*** | (2006.01) |
| ***H04R 3/04*** | (2006.01) |
| ***H04R 1/26*** | (2006.01) |
| *H04R 29/00* | (2006.01) |
| *H04R 1/02* | (2006.01) |

(52) U.S. Cl.

CPC ..... *H04R 3/14* (2013.01); *H04R 1/26* (2013.01); *H04R 3/04* (2013.01); *H04R 1/026* (2013.01)

(58) Field of Classification Search

CPC ... H04R 3/04; H04R 3/12; H04R 3/14; H04R 2430/03; H04R 29/001; H04R 2227/005; H04R 1/24; H04R 2499/11; H04R 5/02; H04R 5/04; H04R 1/323; H04R 2420/07; H04R 9/06; H04R 29/002; H04R 1/26; H04R 1/227; H04R 2205/022; H04R 2205/026; H04R 2420/01; H04S 7/307; H04S 7/301; H04S 2400/01; H04S 7/308; H04S 2400/13; H04S 1/00; H04S 2400/05; H04S 2400/07; H04S 2420/07; H04S 3/008

USPC ..... 381/59, 123, 300, 58, 98, 103, 307, 56, 381/80, 81, 99, 1, 303

See application file for complete search history.

(56) References Cited

U.S. PATENT DOCUMENTS 4,243,840 A * 1/1981 Kates ..... H04R 3/14 381/99

7,003,124 B1 * 2/2006 Thiel ..... H04R 3/14 381/99

(Continued)

*Primary Examiner* — Norman Yu

(74) *Attorney, Agent, or Firm* — Fiala & Weaver P.L.L.C.

(57) ABSTRACT

A loudspeaker system is described that includes a loudspeaker and an extender. The loudspeaker can be positioned on the ground and the extender can be optionally connected thereto. When the extender is connected to the loudspeaker, the loudspeaker is capable of selectively sending high-frequency components of an input audio signal to the extender and the extender is capable of playing back such high-frequency components to produce high-frequency audio. Due to the fact that an audio-producing apparatus of the extender can be positioned at a higher elevation than the loudspeaker, the high-frequency audio (which is more directional than lower-frequency audio) can be produced at a height that is likely to match that of the ear height of a user as opposed to producing the audio at floor height.

20 Claims, 15 Drawing Sheets

(56) References Cited

U.S. PATENT DOCUMENTS

| | | | | |
|---|---|---|---|---|
| 2010/0290643 | A1* | 11/2010 | Mihelich | H04S 7/301 381/99 |
| 2012/0148075 | A1* | 6/2012 | Goh | H04S 7/301 381/303 |
| 2013/0287228 | A1* | 10/2013 | Kallai | H04R 3/14 381/107 |
| 2014/0003625 | A1* | 1/2014 | Sheen | H03G 5/005 381/103 |

* cited by examiner

1205

1200

The selectively boosting or attenuating at least one of the one or more low-frequency signal components and at least one of the one or more high-frequency signal components comprises selectively boosting or attenuating at least one of the one or more low-frequency signal components and at least one of the one or more high-frequency signal components based on one or more of: a response measured using one or more microphones, each of the one or more microphones being included within or connected to the loudspeaker or the extender and current and voltage responses of at least one of the loudspeaker and the extender

FIG. 12

1305

1300

In response to determining that a second extender is connected to the loudspeaker processing the input audio signal to produce one or more mid-range frequency signal components and sending at least one of the one or more mid-range frequency signal components to a mid-range-frequency audio production apparatus of the second extender for conversion into mid-range-frequency audio

FIG. 13

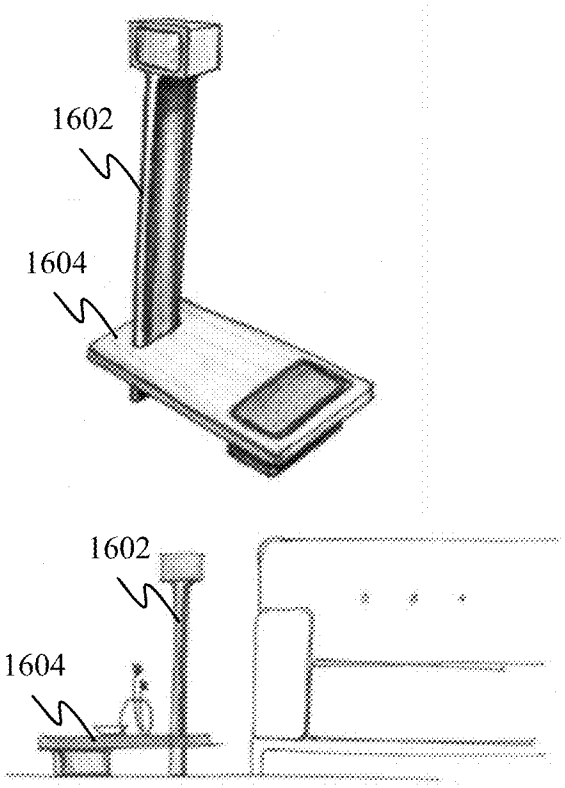
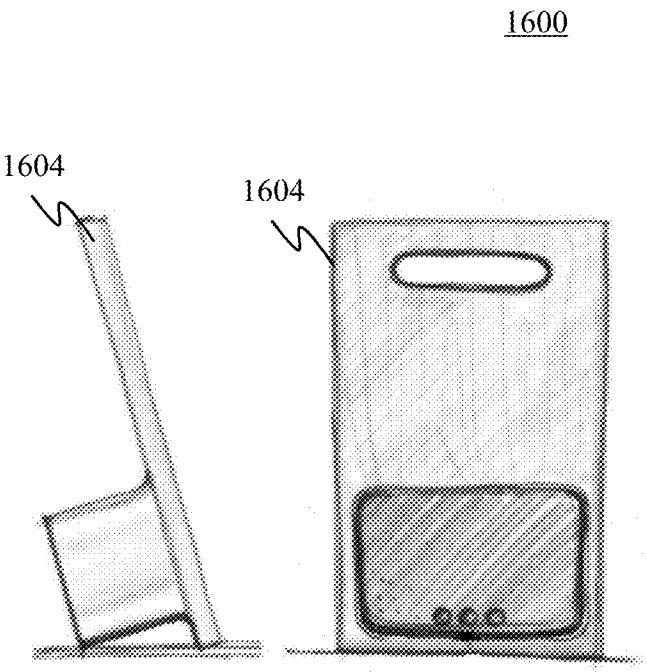
FIG. 16

LOUDSPEAKER WITH OPTIONAL EXTENDER FOR PRODUCTION OF HIGH-FREQUENCY AUDIO

CROSS-REFERENCE TO RELATED APPLICATIONS

This application claims priority to U.S. Provisional Patent Application No. 62/274,906, filed Jan. 5, 2016 and entitled "Loudspeaker with Optional Extender for Production of High-Frequency Audio," the entirety of which is incorporate by reference herein.

BACKGROUND

Technical Field

The subject matter described herein relates to loudspeakers.

Description of Related Art

Loudspeakers (or simply "speakers") must be placed carefully within a listening environment in order for them to sound good. The higher the frequency of the audio signals to be played back by a loudspeaker, the more directional the loudspeaker becomes; in this context, "directional" means that the audio produced by the loudspeaker sounds different from different directions. Consequently, most loudspeakers are designed to have an axis or cone for ideal listening. This axis or cone must be pointed toward a listener's ideal listening area (e.g., in a home) when placing the loudspeaker. This places a significant constraint on the user's choice of where to place the loudspeaker.

In terms of size, there are essentially two types of loudspeakers: (a) floor-standing loudspeakers that are relatively tall and when placed on the floor, their axis of listening matches roughly the ear height when the user is sitting on a couch; and (b) bookshelf loudspeakers that need to be put on a wall or on a speaker stand so as to match their axis of listening to the ear height of the user. Conventional bookshelf loudspeakers cannot be placed on the ground and be expected to deliver high-quality sound to the listening area of the user.

BRIEF SUMMARY

A loudspeaker system is described herein that includes a loudspeaker and an extender. In an embodiment, the loudspeaker can be positioned on the ground and the extender can be optionally connected thereto. When the extender is connected to the loudspeaker, the loudspeaker is capable of selectively sending high-frequency components of an input audio signal to the extender and the extender is capable of playing back such high-frequency components to produce high-frequency audio. Due to the fact that an audio-producing apparatus of the extender can be positioned at a higher elevation than the loudspeaker, the high-frequency audio (which is more directional than lower-frequency audio) can be produced at a height that is likely to match that of the ear height of a user as opposed to producing the audio at floor height.

BRIEF DESCRIPTION OF THE DRAWINGS/FIGURES

The accompanying drawings, which are incorporated herein and form a part of the specification, illustrate embodiments and, together with the description, further serve to explain the principles of the embodiments and to enable a person skilled in the pertinent art to make and use the embodiments.

FIG. 12 depicts a flowchart further illustrating the method of FIG. 11.

FIG. 13 depicts a flowchart of a method performed by audio processing logic of a loudspeaker in accordance with another embodiment.

FIG. 16 is a block diagram of another implementation of an example loudspeaker system in accordance with an embodiment.

Embodiments will now be described with reference to the accompanying drawings.

DETAILED DESCRIPTION

I. Introduction

The present specification discloses numerous example embodiments. The scope of the present patent application is not limited to the disclosed embodiments, but also encompasses combinations of the disclosed embodiments, as well as modifications to the disclosed embodiments.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

II. Example Embodiments

Example embodiments described herein comprise a loudspeaker (e.g., a bookshelf loudspeaker) that can be positioned on the ground and an extender that can be optionally connected thereto. When the extender is connected to the loudspeaker, the loudspeaker is capable of selectively sending high-frequency components of an input audio signal to the extender and the extender is capable of playing back such high-frequency components to produce high-frequency audio. Due to the fact that the audio-producing apparatus of the extender is positioned at a higher elevation than the loudspeaker, the high-frequency audio (which is more directional than lower-frequency audio) can be produced at a height that is likely to match that of the ear height of a user as opposed to producing the audio at floor height.

Figure 1:
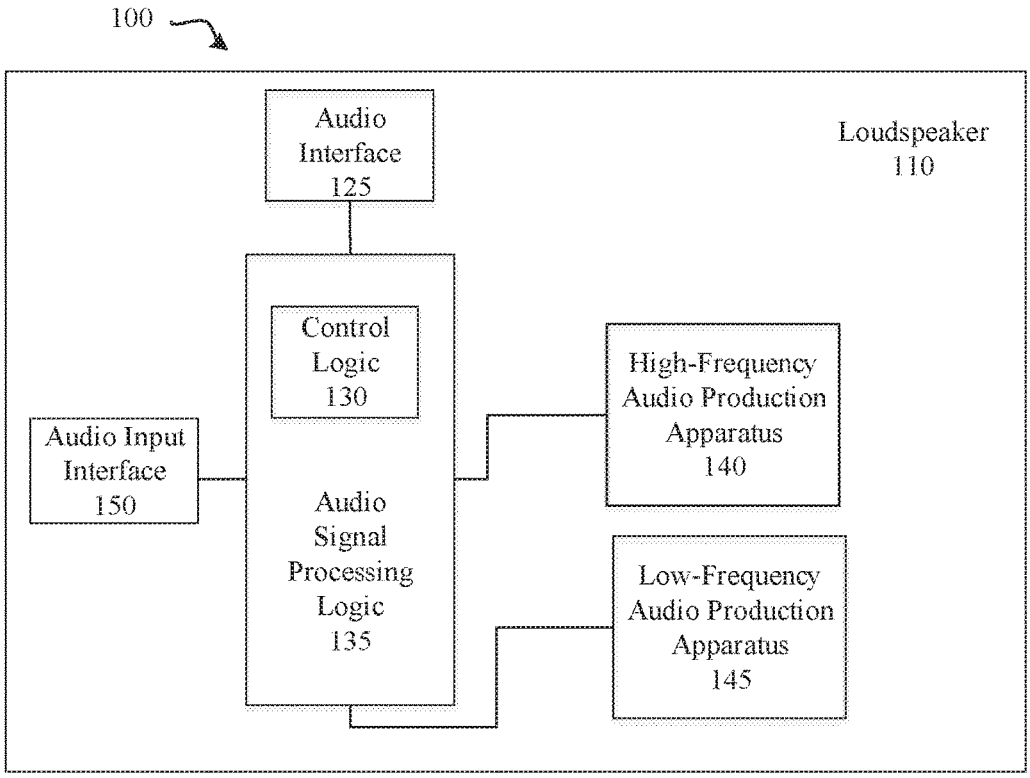
FIG. 1 is a block diagram of an example loudspeaker system in accordance with an embodiment.

FIG. 1 is a block diagram of a loudspeaker system 100 in accordance with an embodiment. As shown in FIG. 1, loudspeaker system 100 includes a bookshelf loudspeaker 110. The bookshelf loudspeaker 110 includes at least the following components: an audio input interface 150, audio signal processing logic 135, a high-frequency audio production apparatus 140, a low-frequency audio production apparatus 145, and an audio interface 125.

Audio input interface 150 is configured to receive an input audio signal from an external device, such as an A/V receiver, television, game console, DVD player, set-top box, or the like, and then send the input audio signal to audio signal processing logic 135. Audio input interface 150 may accommodate a wired or wireless connection to the external device. That is to say, the input audio signal may be provided to audio input interface 150 via a wired or wireless communication medium. Audio signal processing logic 135 of bookshelf loudspeaker 110 is configured to receive the input audio signal from audio input interface 150.

As further shown in FIG. 1, audio signal processing logic 135 of bookshelf loudspeaker 110 includes control logic 130. Control logic 130 is capable of sensing, detecting or otherwise determining whether or not an extender (not shown in FIG. 1) has been connected to bookshelf loudspeaker 110. When control logic 130 determines that an extender is not connected to the bookshelf loudspeaker 110 (as shown in FIG. 1), then control logic 130 causes audio signal processing logic 135 to operate in the following manner. Audio signal processing logic 135 processes the input audio signal to produce high-frequency components thereof and passes one or more of such high-frequency components to first high-frequency audio production apparatus 140 of bookshelf loudspeaker 110, which converts the one or more high-frequency components into high-frequency audio that can be perceived by a user. Audio signal processing logic 135 also processes the input audio signal to produce low-frequency components thereof and passes such low-frequency components to low-frequency audio production apparatus 145 of bookshelf loudspeaker 110, which converts the low-frequency components into low-frequency audio that can be perceived by a user. The manner of operation of control logic 130 when an extender is connected to bookshelf loudspeaker 110 will be discussed elsewhere herein.

As still further shown in FIG. 1, bookshelf loudspeaker 110 further includes audio interface 125 which is capable of interfacing (i.e., sending and receiving information such as audio signals or audio signal components, control signals, or the like) with other components, which will be discussed elsewhere herein.

Figure 2:
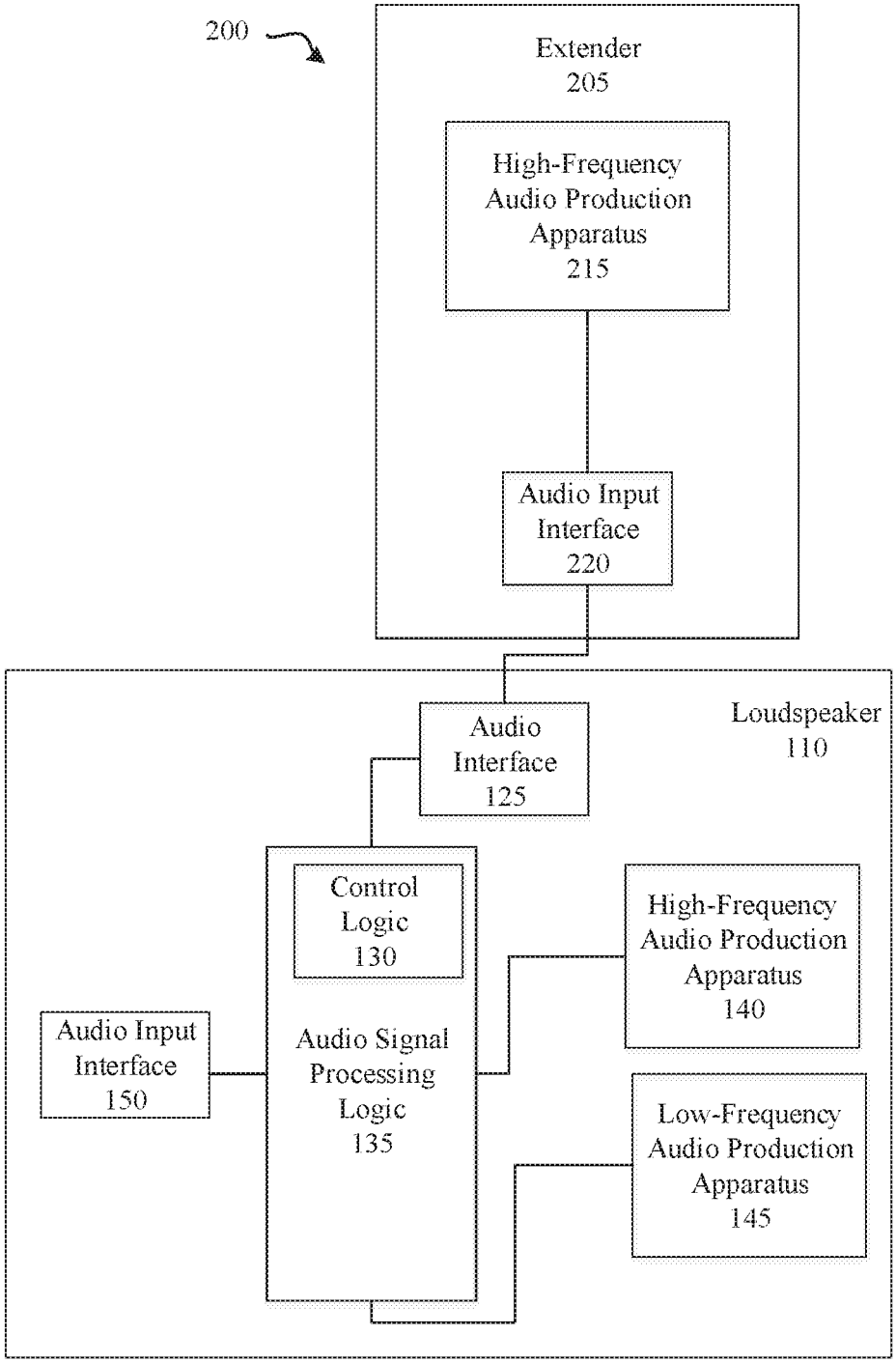
FIG. 2 is a block diagram of an example loudspeaker system in accordance with another embodiment.

FIG. 2 is a block diagram of a loudspeaker system 200 in accordance with another embodiment. As shown in FIG. 2, loudspeaker system 200 includes bookshelf loudspeaker 110 of FIG. 1 and an extender 205 that can be optionally connected thereto. Extender 205 and bookshelf loudspeaker 110 can be connected through an audio jack for example. However, this example is not limiting and the connection between bookshelf loudspeaker 110 and extender 205 can comprise any type of wireless or wired connection. Furthermore, depending on the type of connection mechanism used, bookshelf loudspeaker 110 and extender 205 can be either physically touching or not physically touching.

As shown in FIG. 2, extender 205 includes at least the following components: a high-frequency audio production apparatus 215 and an audio interface 220.

A manner of operation of loudspeaker system 200 will now be described. When control logic 130 determines that extender 205 is not connected to bookshelf loudspeaker 110, control logic 130 causes audio signal processing logic 135 to operate in the previously-described manner. However, when control logic 130 determines that extender 205 is connected to the bookshelf loudspeaker 110 (as shown in FIG. 2), control logic 130 causes audio signal processing logic 135 to operate in the following manner. Audio signal processing logic 135 processes the input audio signal to produce high-frequency components thereof and passes one or more of the high-frequency components to high-frequency audio production apparatus 215 of extender 205. As shown in FIG. 2, the one or more high-frequency components are passed via audio interface 125 of bookshelf loudspeaker 110 to audio interface 220 of extender 205. High-frequency audio production apparatus 215 of extender 205 converts the one or more high-frequency components of the input audio signal into high-frequency audio that can be perceived by a user. In certain embodiments, audio signal processing logic 135 may also pass one or more of the high-frequency components to the high-frequency audio production apparatus 140 of loudspeaker 110 and high-frequency audio production apparatus 140 converts the one or more high-frequency components into high-frequency audio that can be perceived by a user. Alternatively, all of the high-frequency components may be passed to the high-frequency audio production apparatus 215 of extender 205 for conversion into high-frequency audio that can be perceived by a user. Audio signal processing logic 135 also processes the input audio signal to produce low-frequency components thereof and passes such low-frequency components to low-frequency audio production apparatus 145 of bookshelf loudspeaker 110, which converts the low-frequency components into low-frequency audio that can be perceived by a user.

Thus, in an embodiment, when extender 205 is connected to bookshelf loudspeaker 110, it is automatically utilized to play back one or more high-frequency components of the input audio signal. However, when extender 205 is not connected to bookshelf loudspeaker 110, bookshelf loudspeaker 110 itself plays back such one or more high-frequency components. In an alternate embodiment, when extender 205 is connected to bookshelf loudspeaker 110, both bookshelf loudspeaker 110 and extender 205 are utilized to play back high-frequency components of the input audio signal.

In embodiments, either of high-frequency audio production apparatus 140 or high-frequency audio production apparatus 215 comprises a woofer, a mid-range driver, or a tweeter, and low-frequency audio production apparatus 145 comprises a mid-range driver, woofer, and/or sub-woofer. However, these are examples only and are not intended to be limiting. Furthermore, it is to be understood that the input audio signal may be processed to obtain more than two frequency bands (i.e., more than simply "low-frequency components" and "high-frequency components"), and that each frequency band may be played back by a different audio production apparatus. In any case, however, connection of extender 205 to bookshelf speaker 110 causes at least some of the frequency bands or components to be directed to extender 205 for playback thereby.

In an embodiment, extender 205 is designed in such a fashion that, when it is connected to bookshelf speaker 110, high-frequency audio production apparatus 215 of extender 205 is situated at a higher position than (i.e., is elevated above) bookshelf loudspeaker 110. In this configuration, bookshelf loudspeaker 110 generates the low-frequency audio which is not as directional in nature as the high-frequency audio. Thus, bookshelf loudspeaker 110 can be placed on the floor (i.e., not at ear-height) without impairing the user's listening experience. However, the high-frequency audio, which is directional in nature, is produced by the elevated high-frequency audio production apparatus 215 of extender 205, and thus can be generated at or near the ear-height of the user, which is desirable. Thus, embodiments of loudspeaker system 200 provide the user with a variety of configuration options. Without extender 205, bookshelf loudspeaker 110 can be placed or mounted at ear-height to achieve a desired listening arrangement, or, with extender 205, bookshelf loudspeaker 110 can be placed on the floor and extender 205 can be utilized to ensure that directional, high-frequency audio is still produced at or near the nominal listening height as that of a floor standing speaker.

In an embodiment, one or more components of loudspeaker system 200 are powered by a power source that is connected to or contained within bookshelf loudspeaker 110. In another embodiment, one or more components of loudspeaker system 200 are powered by a power source that is connected to or contained within extender 205. In yet another embodiment, one or more components of loudspeaker system 200 does not require a power source.

Figure 3:
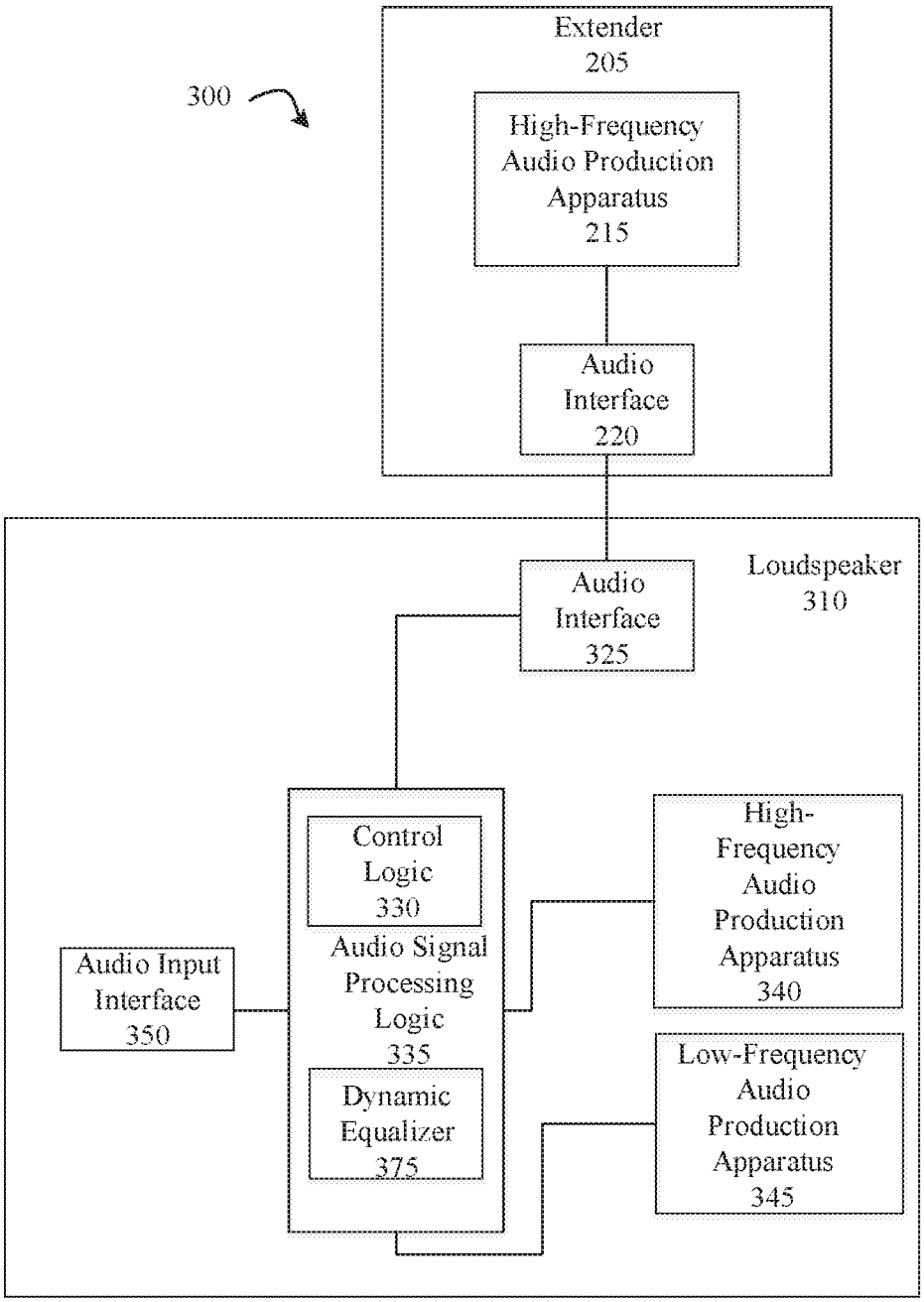
FIG. 3 is a block diagram of an example loudspeaker system in accordance with another embodiment.

FIG. 3 is a block diagram of a loudspeaker system 300 in accordance with another embodiment. As shown in FIG. 3, loudspeaker system 300 includes a bookshelf loudspeaker 310 and extender 205 of FIG. 2 that can be optionally connected thereto. Bookshelf loudspeaker 310 is substantially similar to bookshelf loudspeaker 110 of FIGS. 1 and 2. For example, bookshelf loudspeaker 310 includes an audio input interface 350, audio signal processing logic 335, control logic 330, high-frequency audio production apparatus 340, low-frequency audio production apparatus 345, and an audio interface 325. These components are substantially similar to audio input interface 150, audio signal processing logic 135, control logic 130, high-frequency audio production apparatus 140, low-frequency audio product apparatus 145, and audio interface 125, respectively, of bookshelf loudspeaker 110 as described above in reference to FIGS. 1 and 2. However, in contrast to bookshelf loudspeaker 110, audio signal processing logic 335 of bookshelf loudspeaker 310 further includes a dynamic equalizer 375 which may be used to improve the quality of the audio produced thereby.

In an embodiment, dynamic equalizer 375 is configured to selectively boost or attenuate different frequency bands or components of the input audio signal with the goal of improving sound quality. The manner of operation of dynamic equalizer 375 may vary depending upon whether or not extender 205 is connected to bookshelf loudspeaker 310 and/or where in a room loudspeaker system 300 is placed. Dynamic equalizer 375 operation may be guided not only by the knowledge of whether extender 205 is connected to bookshelf loudspeaker 310 but also by the use of one or both of the following two methods: (1) using one or more microphones that are included in or otherwise connected to bookshelf loudspeaker 310 and/or extender 205; and (2) monitoring a current and/or voltage response of bookshelf loudspeaker 310 and/or extender 205 at various frequencies and comparing such responses to an existing database of such responses. These approaches will be described in more detail herein.

In an embodiment, audio processing signal logic 335 uses a cross-over frequency to distinguish between the one or more low-frequency signal components and the one or more high-frequency signal components. More specifically, audio signal processing logic 335 may determine that signal components that have a frequency higher that the cross-over frequency are high-frequency components and that signal components that have a frequency lower than the cross-over frequency are low-frequency components. It should be understood that the cross-over frequency can be a fixed parameter or an adjustable parameter. The cross-over frequency can be dynamically adjusted in a number of ways. In an embodiment, the cross-over frequency is dynamically adjusted based on a number of speakers in the room. In another embodiment, the cross-over frequency is dynamically adjusted based on a response associated with the room. In yet another embodiment, the cross-over frequency is dynamically adjusted based on a user input. The user input can be provided by the user through, for example, interaction with a knob or dial on bookshelf loudspeaker 310, a remote controller that is wired or wirelessly connected to bookshelf loudspeaker 310, or the like.

Figure 4:
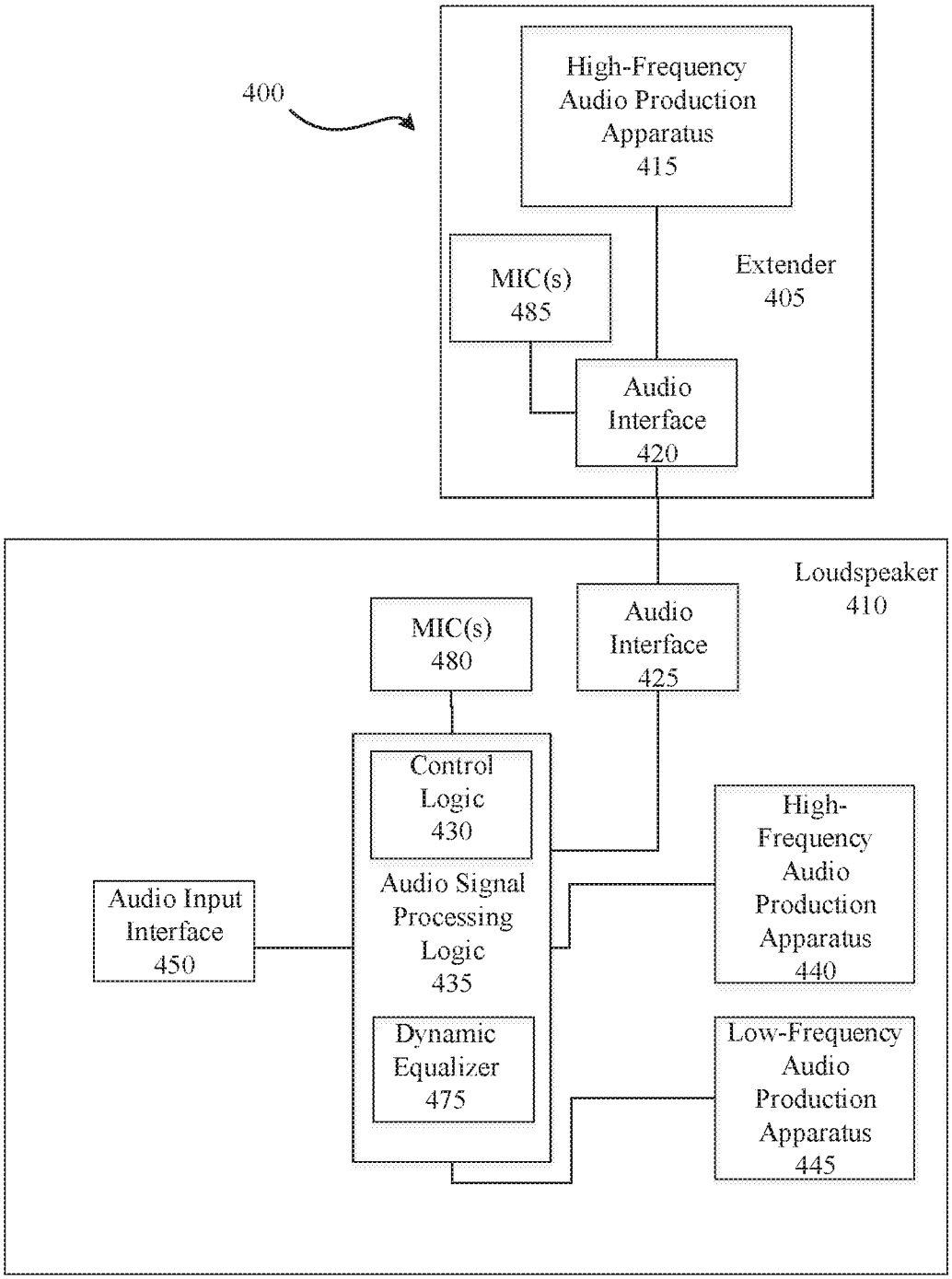
FIG. 4 is a block diagram of an example loudspeaker system in accordance with another embodiment.

FIG. 4. is a block diagram of a loudspeaker system 400 in accordance with another embodiment. As shown in FIG. 4, loudspeaker system 400 includes bookshelf loudspeaker 410 and extender 405. Bookshelf loudspeaker 410 and extender 405 are substantially similar to bookshelf loudspeaker 310 and extender 205 as previously discussed. For example, bookshelf loudspeaker 410 includes an audio input interface 450, audio signal processing logic 435, control logic 430, dynamic equalizer 475, high-frequency audio production apparatus 440, low-frequency audio production apparatus 445, and an audio interface 425. These components are substantially similar to audio input interface 350, audio signal processing logic 335, control logic 330, high-frequency audio production apparatus 340, low-frequency audio product apparatus 345, and audio interface 325, respectively, of bookshelf loudspeaker 310 as described above in reference to FIG. 3. Furthermore, extender 405 includes an audio interface 420 and high-frequency audio production apparatus 415 that are substantially similar to audio interface 220 and high-frequency audio production apparatus 215, respectively, of extender 205. However, as shown in FIG. 4, bookshelf loudspeaker 410 and extender 405 each further include a respective one or more microphone(s) 480, 485.

In this embodiment, dynamic equalizer 475 can boost or attenuate certain frequency components of the input audio signal by using the first method described above: namely, by using microphone(s) 480, 485 that are included in or otherwise connected to bookshelf loudspeaker 410 and/or extender 405. In particular, microphones(s) 480 collect audio response signals and send the audio response signals to dynamic equalizer 475. Microphone(s) 485 also collect audio response signals and then send the audio response signals to dynamic equalizer 475 via audio interface 420 and audio interface 425. Dynamic equalizer 475 can use the audio response signals received in this manner to improve the sound quality. Dynamic equalizer 475 may store or access a database of target audio response signals and compare the audio response signals received from one or both of microphones(s) 480, 485. By comparing the audio response signals in this manner, dynamic equalizer 475 can determine if certain frequency components of the input audio signal should be boosted or attenuated based on the room and/or configuration of speakers.

It should be noted that in embodiments only extender 405 may contain microphone(s) 485 or only bookshelf loudspeaker 410 may contain microphones(s) 480. It should further be noted that if both extender 405 and bookshelf loudspeaker 410 contain one or more microphone(s), that the number of one or more microphone(s) present in each does not have to be the same.

Figure 5:
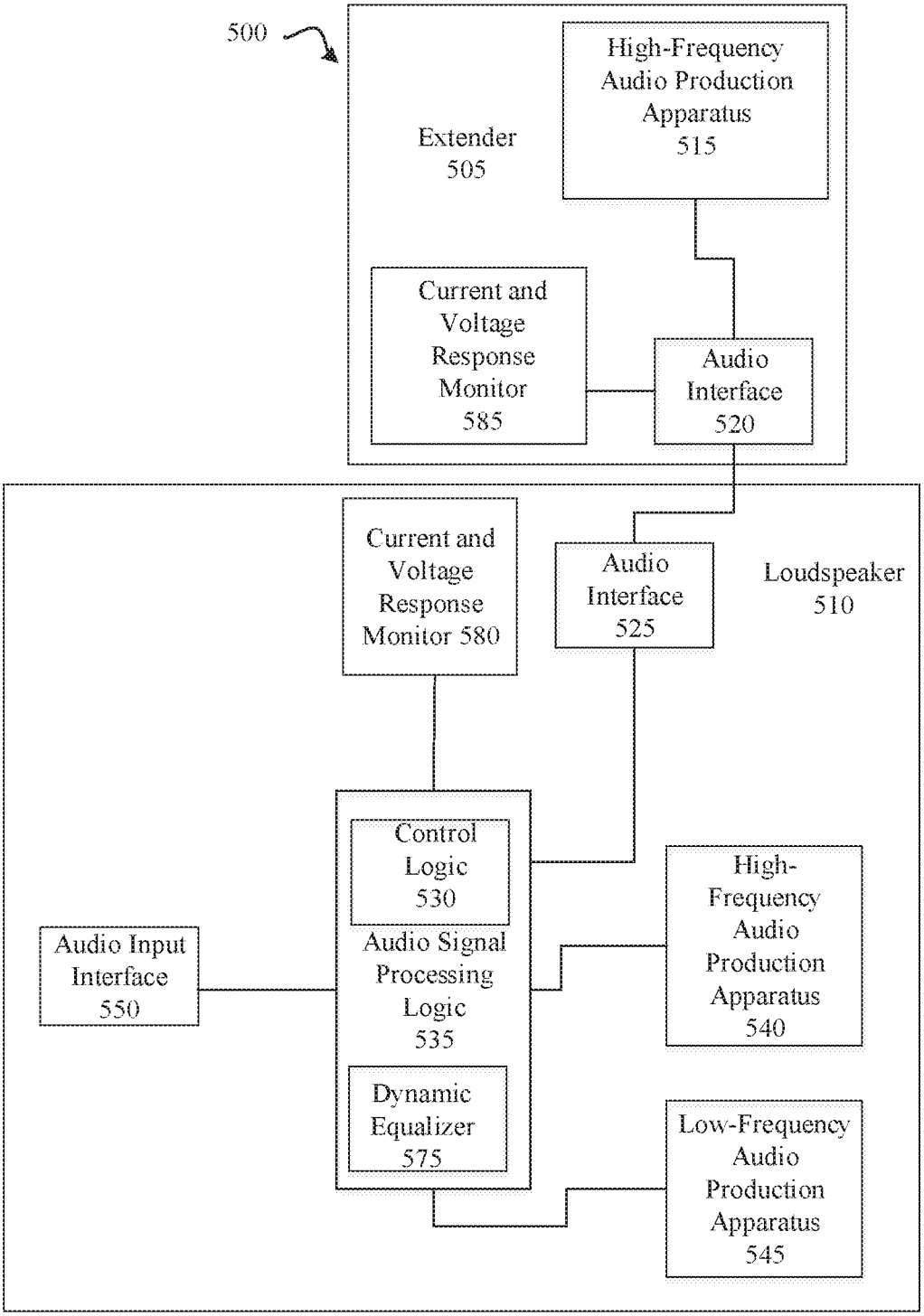
FIG. 5 is a block diagram of an example loudspeaker system in accordance with another embodiment.

FIG. 5. is a block diagram of a loudspeaker system 500 in accordance with another embodiment. As shown in FIG. 5, loudspeaker system 500 includes bookshelf loudspeaker 510 and extender 505. Bookshelf loudspeaker 510 and extender 505 are substantially similar to bookshelf loudspeaker 310 and extender 205 as previously discussed. For example, bookshelf loudspeaker 510 includes an audio input interface 550, audio signal processing logic 535, control logic 530, dynamic equalizer 575, high-frequency audio production apparatus 540, low-frequency audio production apparatus 545, and an audio interface 525. These components are substantially similar to audio input interface 350, audio signal processing logic 335, control logic 330, high-frequency audio production apparatus 340, low-frequency audio product apparatus 345, and audio interface 325, respectively, of bookshelf loudspeaker 310 as described above in reference to FIG. 3. Furthermore, extender 505 includes an audio interface 520 and high-frequency audio production apparatus 515 that are substantially similar to audio interface 220 and high-frequency audio production apparatus 215, respectively, of extender 205. However, as shown in FIG. 5, bookshelf loudspeaker 510 and extender 505 each further include a respective current and voltage response monitor 580, 585.

In an embodiment, dynamic equalizer 575 can boost or attenuate certain frequency components of the input audio signal by using the second method described above: namely, monitoring the current and voltage response of bookshelf loudspeaker 510 and/or extender 505. In particular, current and voltage response monitor 580 that is included in bookshelf loudspeaker 510 obtains and sends current and voltage response measurements to dynamic equalizer 575. Current and voltage response monitor 585 that is included in extender 505 obtains and sends current and voltage response measurements to dynamical equalizer 575 via audio interface 520 and audio interface 525. The current and voltage response measurements can be used by dynamic equalizer 575 to improve the sound quality. For example, dynamic equalizer 575 can store or access a database of target current and voltage response measurements and compare the current and voltage response measurements received from current and voltage response monitor 580 and/or current and voltage response monitor 585. By comparing the current and voltage response measurements, dynamic equalizer 575 can determine if certain frequency components should be boosted or attenuated based on the room and/or configuration of speakers.

It should be noted that in embodiments only extender 505 may contain a current and voltage response monitor 585 or only bookshelf loudspeaker 510 may contain current and voltage response monitor 580.

Figure 6:
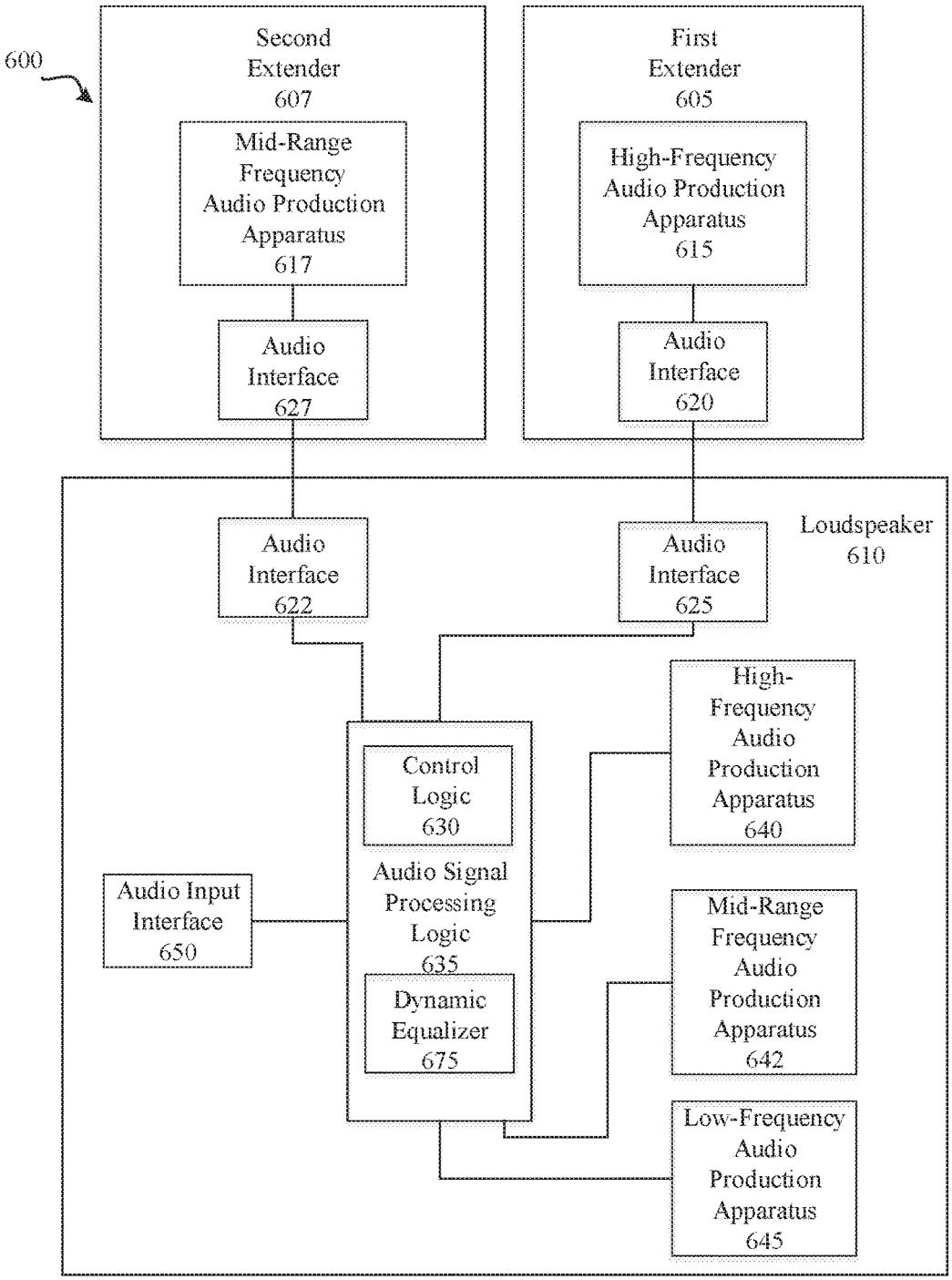
FIG. 6 is a block diagram of an example loudspeaker system in accordance with another embodiment.

FIG. 6 is a block diagram of a loudspeaker system 600 in accordance with another embodiment. As shown in FIG. 6, loudspeaker system 600 includes a bookshelf loudspeaker 610, a first extender 605, and a second extender 607. Bookshelf loudspeaker 610 includes at least the following components: an audio input interface 650, audio signal processing logic 635, a high-frequency audio production apparatus 640, a mid-range frequency audio production apparatus 642, a low-frequency audio production apparatus 645, an audio interface 622, and an audio interface 625. First extender 605 includes at least the following components: an audio interface 620 and a high-frequency audio production apparatus 615. Second extender 607 includes at least the following components: an audio interface 627 and a mid-range frequency audio production apparatus 617.

Audio input interface 650 is configured to receive an input audio signal from an external device, such as the previously-noted external devices, and then send the input audio signal to audio signal processing logic 635. Audio signal processing logic 635 is configured to receive the input audio signal from audio input interface 650.

As further shown in FIG. 6, audio signal processing logic 635 includes control logic 630 and a dynamic equalizer 675. In an embodiment, control logic 630 is capable of sensing, detecting or otherwise determining whether first extender 605, second extender 607, or both, have been connected to bookshelf loudspeaker 610. When control logic 630 determines that both extender 605 and second extender 607 are connected to the bookshelf loudspeaker 610 (as shown in FIG. 6) control logic 630 causes audio signal processing logic 635 to operate in the following manner.

Audio processing logic 635 processes the input audio signal to produce mid-range-frequency components thereof and passes one or more of the mid-range-frequency components to mid-range frequency production apparatus 617 of second extender 607 via audio interfaces 622, 627. Mid-range frequency audio production apparatus 617 then converts the one or more mid-range-frequency components into mid-range-frequency audio that can be perceived by a user. In certain embodiments, audio signal processing logic 635 may also pass one or more of the mid-range-frequency components to the mid-range-frequency audio production apparatus 642 of loudspeaker 610 and mid-range frequency audio production apparatus 642 converts the one or more mid-range-frequency components into mid-range-frequency audio that can be perceived by a user. Alternatively, all of the mid-range-frequency components may be passed to the mid-range frequency audio production apparatus 617 of second extender 607 for conversion into mid-range-frequency audio that can be perceived by a user.

Audio processing logic 635 also processes the input audio signal to produce high-frequency components and passes one or more of the high-frequency components to high-frequency audio production apparatus 615 of extender 605 via audio interfaces 620, 625. High-frequency audio production apparatus 615 then converts the one or more high-frequency components into high-frequency audio that can be perceived by a user. In certain embodiments, audio signal processing logic 635 may also pass one or more of the high-frequency components to the high-frequency audio production apparatus 640 of loudspeaker 610 and high-frequency audio production apparatus 640 converts the one or more high-frequency components into high-frequency audio that can be perceived by a user. Alternatively, all of the high-frequency components may be passed to the high-frequency audio production apparatus 615 of extender 605 for conversion into high-frequency audio that can be perceived by a user. Audio processing logic 635 also processes the input audio signal to produce low-frequency components and passes such low-frequency components to low-frequency audio production apparatus 645 of bookshelf loudspeaker 610, which converts the low-frequency components into low-frequency audio that can be perceived by a user. It should be noted that these embodiments are not to be construed in a limiting sense and any of these embodiments may be used in configuration with each other.

In an embodiment, when control logic 630 determines that first extender 605 is not connected to bookshelf speaker 610, then control logic 630 causes audio signal processing logic 635 to route the one or more high-frequency components of the input audio signal to high-frequency audio production apparatus 640 of bookshelf loudspeaker 610, which converts the high-frequency components into high-frequency audio that can be perceived by a user.

In an embodiment, when control logic 630 determines that second extender 607 is not connected to bookshelf speaker 610, then control logic 630 causes audio signal processing logic 635 to route the one or more mid-range-frequency components of the input audio signal to mid-range-frequency audio production apparatus 642 of bookshelf loudspeaker 610, which converts the one or more mid-range-frequency components into mid-range-frequency audio that can be perceived by a user. Dynamic equalizer 675 is configured to selectively boost or attenuate different frequency bands or components of the input audio signal with the goal of improving sound quality. The manner of operation of dynamic equalizer 675 may vary depending upon whether first extender 605, second extender 607, or both are connected to bookshelf loudspeaker 610 and/or where in a room loudspeaker system 600 is placed.

In an embodiment, audio signal processing logic 635 uses first and second cross-over frequencies to distinguish between the one or more low-frequency signal components, the one or more mid-range frequency components and the one or more high-frequency signal components. More specifically, audio signal processing logic 635 may determine that the signal components that have a frequency higher than the first cross-over frequency are high-frequency components, that the signal components that have a frequency lower than the first cross-over frequency and higher than the second cross-over frequency are mid-range frequency components and that the signal components that have a frequency lower than the second cross-over frequency range are low-frequency components. It should be understood that the first and second cross-over frequencies can be fixed parameters or adjustable parameters. The cross-over frequencies can also be dynamically adjusted by dynamic equalizer 675.

It should be noted FIG. 6 is not to be construed in a limiting sense and multiple extenders and/or bookshelf loudspeakers can be included in any of the loudspeaker systems described herein.

Figure 7:
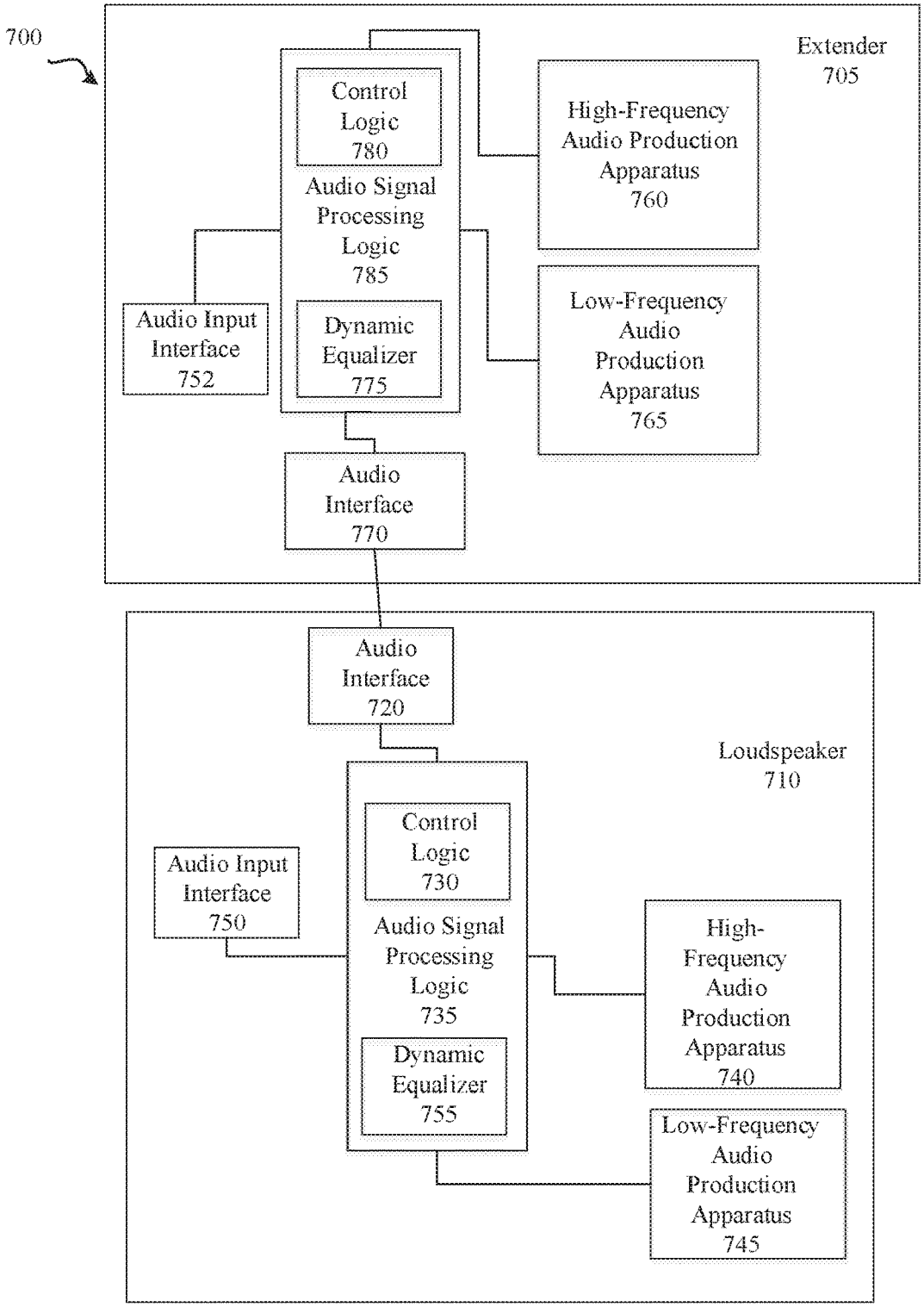
FIG. 7 is a block diagram of an example loudspeaker in accordance with another embodiment.

FIG. 7 is a block diagram of a loudspeaker system 700 in accordance with another embodiment. As shown in FIG. 7, loudspeaker system 700 includes bookshelf loudspeaker 710, and extender 705. Bookshelf loudspeaker 710 includes at least the following components: an audio input interface 750, audio signal processing logic 735, a high-frequency audio production apparatus 740, a low-frequency audio production apparatus 745, and an audio interface 720. Extender 705 includes at least the following components: an audio input interface 752, audio signal processing logic 785, a high-frequency audio production apparatus 760, a low-frequency audio production apparatus 765, and an audio interface 770.

Audio input interfaces 750, 752 are each configured to receive an input audio signal from an external device, such as the previously described external devices, and then send the input audio signal to audio signal processing logic 735, 785 of bookshelf loudspeaker 710 and extender 705, respectively. As shown in FIG. 7, audio signal processing logic 735, 785 are each configured to receive the input audio signal from audio input interfaces 750, 752, respectively.

As further shown in FIG. 7, audio signal processing logic 735 includes control logic 730 and a dynamic equalizer 755, and audio signal processing logic 785 includes control logic 780 and a dynamic equalizer 775.

Audio signal processing logic 785 is capable of processing the input audio signal to produce low-frequency components and high-frequency components thereof. Audio signal processing logic 785 is further capable of passing such one or more high-frequency components to one or both of high-frequency audio production apparatus 760 of extender 705 or high-frequency audio production apparatus 740 of bookshelf loudspeaker 710, which converts the one or more high-frequency components into high frequency audio that can be perceived by a user, and passing such one or more low-frequency components to one or both of low-frequency audio production apparatus 765 of extender 705 or low frequency audio production apparatus 745 of bookshelf loudspeaker 710, which converts the one or more low-frequency components into low-frequency audio that can be perceived by a user.

Audio signal processing logic 735 is capable of processing the input audio signal to produce low-frequency components and high-frequency components thereof. Audio signal processing logic 735 is further capable of passing such one or more high-frequency components to one or both of high-frequency audio production apparatus 760 of extender 705 and high-frequency audio production apparatus 740 of bookshelf loudspeaker 710, which converts the one or more high-frequency components into high-frequency audio that can be perceived by a user, and passing such one or more low-frequency components to one or both of low-frequency audio production apparatus 765 of extender 705 and low-frequency audio production apparatus 745 of bookshelf loudspeaker 710, which converts the one or more low-frequency components into low-frequency audio that can be perceived by a user.

In an embodiment, control logic 730, 780 are capable of sensing, detecting, or otherwise determining whether or not extender 705 is connected to bookshelf loudspeaker 710. When control logic 730, 780 determine that extender 705 is connected to bookshelf loudspeaker 710 (as shown in FIG. 7) control logic 730, 780 cause audio signal processing logic 735, 785 to operate in the following manner.

Control logic 730, 780 communicate via audio interfaces 720, 770 to determine which signal components (i.e., low-frequency signal components or high-frequency signal components) each of audio signal processing logic 735, 785 should produce and where the signal components should be sent (i.e., high-frequency audio production apparatus 760, low-frequency audio production apparatus 765, high-frequency audio production apparatus 740, low-frequency audio production apparatus 745.)

For example, if it is determined that audio signal processing logic 785 will handle the high-frequency signal components and that audio signal processing logic 735 will handle the low-frequency signal components, audio signal processing logic 785 will receive the input audio signal from audio input interface 752, process the input audio signal to produce high-frequency signal components, and send the high-frequency signal components to high-frequency audio production apparatus 760 for conversion into high-frequency audio that can be perceived by a user. Likewise, audio signal processing logic 735 will receive the input audio signal from audio input interface 750, process the input audio signal to produce low-frequency signal components, and send the low-frequency signal components to low-frequency audio production apparatus 745 for conversion into low-frequency audio that can be perceived by a user.

Dynamic equalizers 755, 775 are configured to selectively boost or attenuate different frequency bands or components of the input audio signal with the goal of improving sound quality. In an embodiment, audio signal processing logic 735, 785 use a cross-over frequency to distinguish between the one or more low-frequency signal components and the one or more high-frequency signal components. More specifically, audio signal processing logic 735, 785 may determine that the signal components that have a frequency higher than the cross-over frequency are high-frequency components, and that the signal components that have a frequency lower than the cross-over frequency are low-frequency components. It should be understood that the cross-over frequency can be a fixed parameter or an adjustable parameter. The cross-over frequency can be adjusted by one or both of audio signal processing logic 735, 785.

Figure 8:
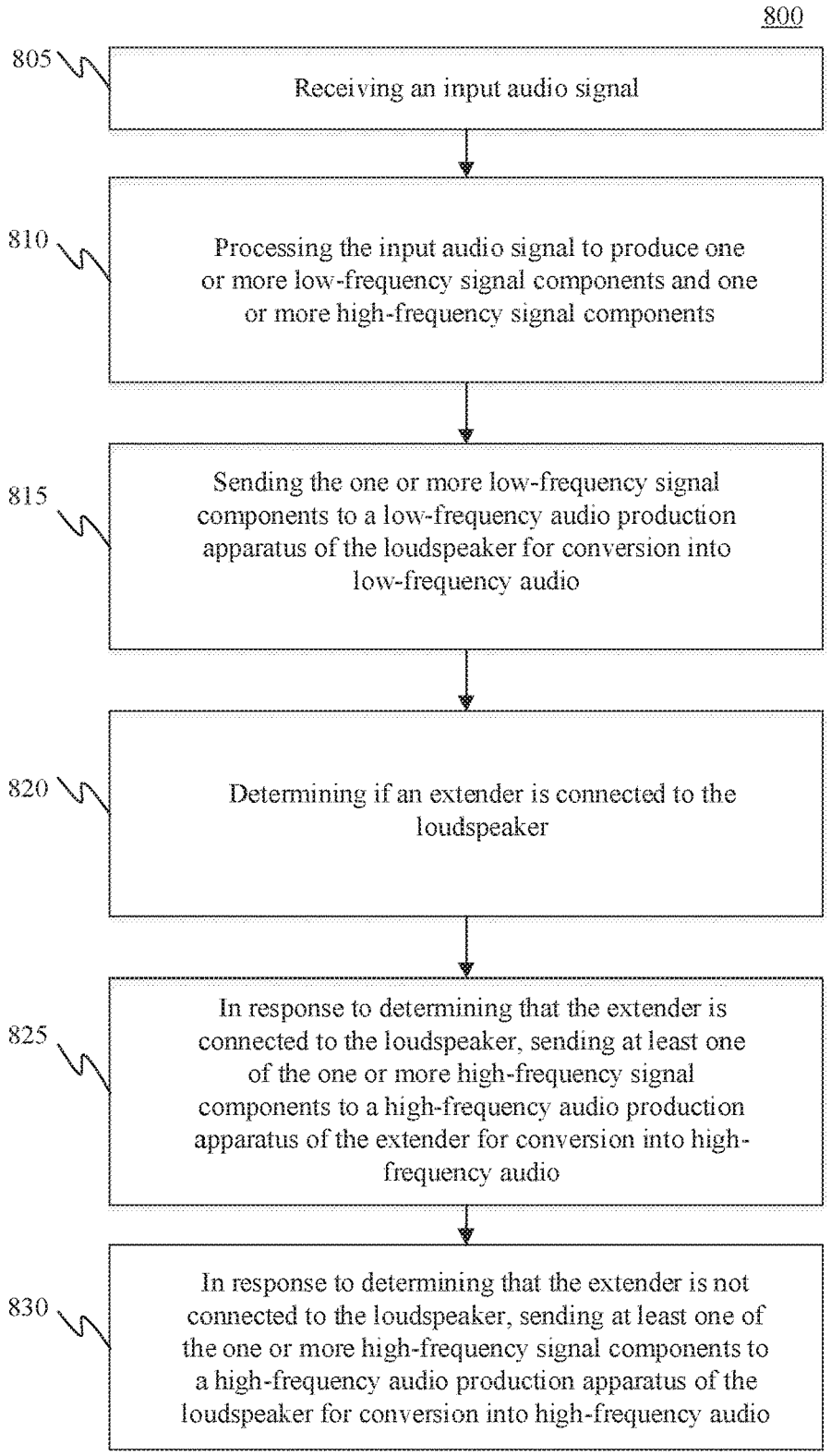
FIG. 8 depicts a flowchart of a method performed by audio processing logic of a loudspeaker in accordance with an embodiment.

FIG. 8 depicts a flowchart 800 of a method of operation of a loudspeaker system in accordance with an embodiment. The method of flowchart 800 may be performed, for example, by the audio signal processing logic of any of the previously-described loudspeakers or extenders. However, the method of flowchart 800 is not limited to those embodiments.

As shown in FIG. 8, the method of flowchart 800 begins at step 805 in which an input audio signal is received.

At step 810, the input audio signal is processed to produce one or more low-frequency signal components and one or more high-frequency signal components.

At step 815, the one or more low-frequency signal components is sent to a low-frequency audio production apparatus of a bookshelf loudspeaker for conversion into low-frequency audio.

At decision step 820, it is determined whether an extender is connected to the bookshelf loudspeaker.

If it is determined during decision step 820 that the extender is connected to the bookshelf loudspeaker, then at least one of the one or more high-frequency signal components is sent to a high-frequency audio production apparatus of the extender (and optionally also to a high-frequency audio production apparatus of the bookshelf loudspeaker) for conversion into high-frequency audio as shown at step 825.

However, if it is determined during decision step 820 that the extender is not connected to the bookshelf loudspeaker, then at least one of the one or more high-frequency signal components is sent to the high-frequency audio production apparatus of the bookshelf loudspeaker only for conversion into high-frequency audio as shown at step 830.

Figure 9:
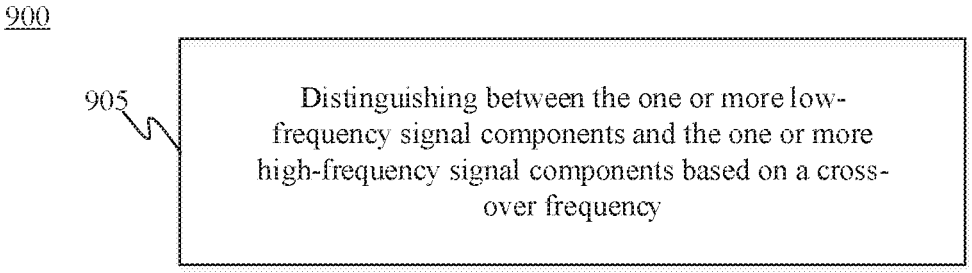
FIG. 9 depicts a flowchart of a method performed by audio processing logic of a loudspeaker in accordance with another embodiment.

FIG. 9 depicts a flowchart 900 of a further method of operation of a loudspeaker system in accordance with an embodiment. At step 905, the one or more low-frequency signal components and the one or more high-frequency signal components are distinguished based on a cross-over frequency. The cross-over frequency can be a fixed parameter that is, for example, determined during manufacturing, or the cross-over frequency can be adjusted based on one or more factors, as further described below in the discussion of FIG. 10. In an embodiment, when the cross-over frequency parameter is a frequency value, any frequency component that is above the frequency value is determined to be a high-frequency component and any frequency component that is below the frequency value is determined to be a low-frequency component.

Figure 10:
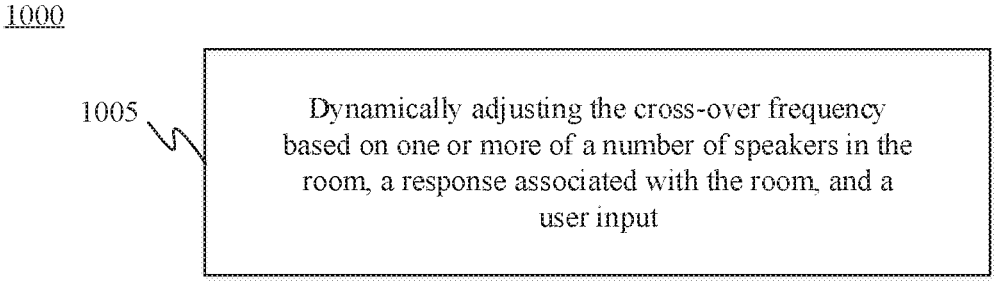
FIG. 10 depicts a flowchart of a method performed by audio processing logic of a loudspeaker in accordance with another embodiment.

FIG. 10 depicts a flowchart 1000 of a method for dynamically adjusting the cross-over frequency. At step 1005, the cross-over frequency is dynamically adjusted based on one or more of a number of speakers in the room, a response associated with the room, and/or a user input. For example, a microphone response signal sent to the extender(s) and/or loudspeaker or a current and voltage response signal, can be used to determine if the cross-over frequency(ies) are appropriate. A user may adjust the cross-over frequency by setting the cross-over frequency using an interface, for example, a remote control or a knob. However, these examples are not meant to be construed in a limiting sense.

Figure 11:
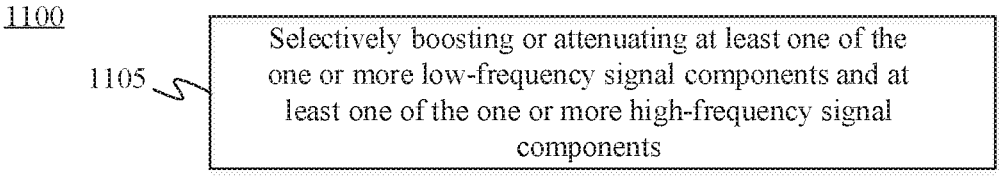
FIG. 11 depicts a flowchart of a method performed by audio processing logic of a loudspeaker in accordance with another embodiment.

FIG. 11 depicts a flowchart 1100 of a further method of operation of a loudspeaker system in accordance with an embodiment. At step 1105, at least one of the one or more low-frequency signal components and at least one of the one or more high-frequency signal components are selectively boosted or attenuated.

FIG. 12 depicts a flowchart 1200 of a method for selectively boosting or attenuating at least one or more low-frequency signal components and at least one of the one or more high-frequency signal components as discussed above in reference to FIG. 11. At step 1205, selectively boosting or attenuating at least one of the one or more low-frequency signal components and at least one of the one or more high-frequency signal components is based on one or more of a response measured using one or more microphones, each of the one or more microphones being included within or connected to the loudspeaker or the extender and current and voltage responses of at least one of the loudspeaker and the extender. The microphone response signal(s) sent to the extender(s) and/or loudspeaker can be used to determine if the one or more low-frequency signal components or the one or more high-frequency signal components need to be boosted or attenuated. The current and voltage response signal(s) sent to the extender(s) and/or loudspeaker can be used to determine if the one or more low-frequency signal components or the one or more high-frequency signal components need to be boosted or attenuated.

FIG. 13 depicts a flowchart 1300 of a further method of operation of a loudspeaker system in accordance with an embodiment. At step 1305, it is determined that a second extender is connected to the bookshelf loudspeaker and then one or more mid-range frequency signal components are produced from the input audio signal. At least one of the one or more mid-range frequency signal components are sent to a mid-range production apparatus of the second extender for conversion into mid-range frequency audio.

Figure 15:
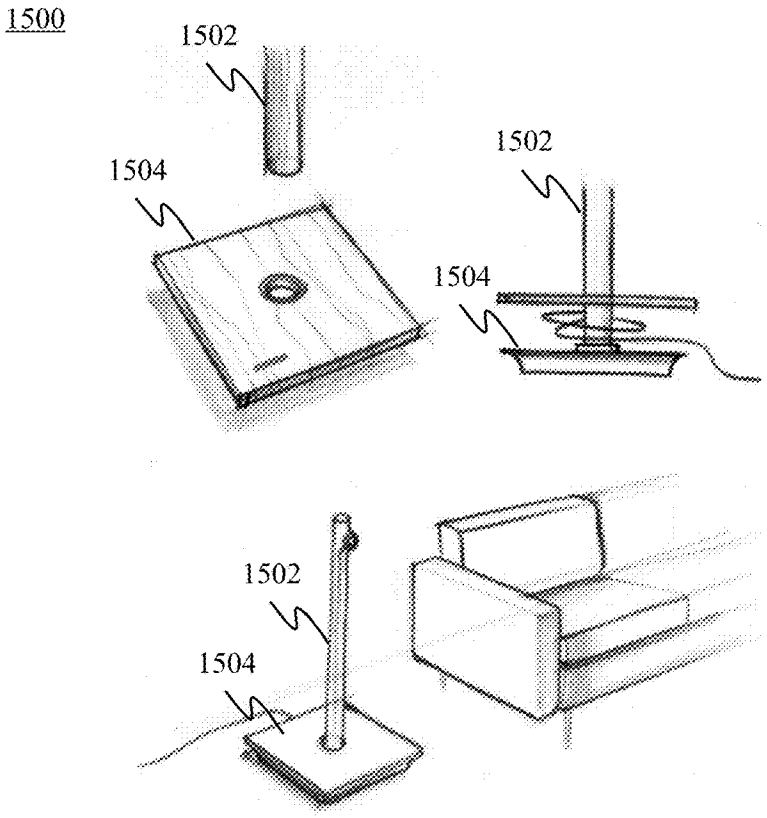
FIG. 15 is a block diagram of one implementation of an example loudspeaker system in accordance with an embodiment.

FIG. 15 depicts a block diagram of one implementation of an example loudspeaker system 1500 in accordance with an embodiment. As shown in FIG. 15, loudspeaker system 1500 includes a loudspeaker 1504 and an extender 1502 that can be optionally connected thereto.

FIG. 16 depicts a block diagram of another implementation of an example loudspeaker system 1600 in accordance with an embodiment. As shown in FIG. 16, loudspeaker system 1600 includes a loudspeaker 1604 and an extender 1602 that can be optionally connected thereto.

Figure 17:
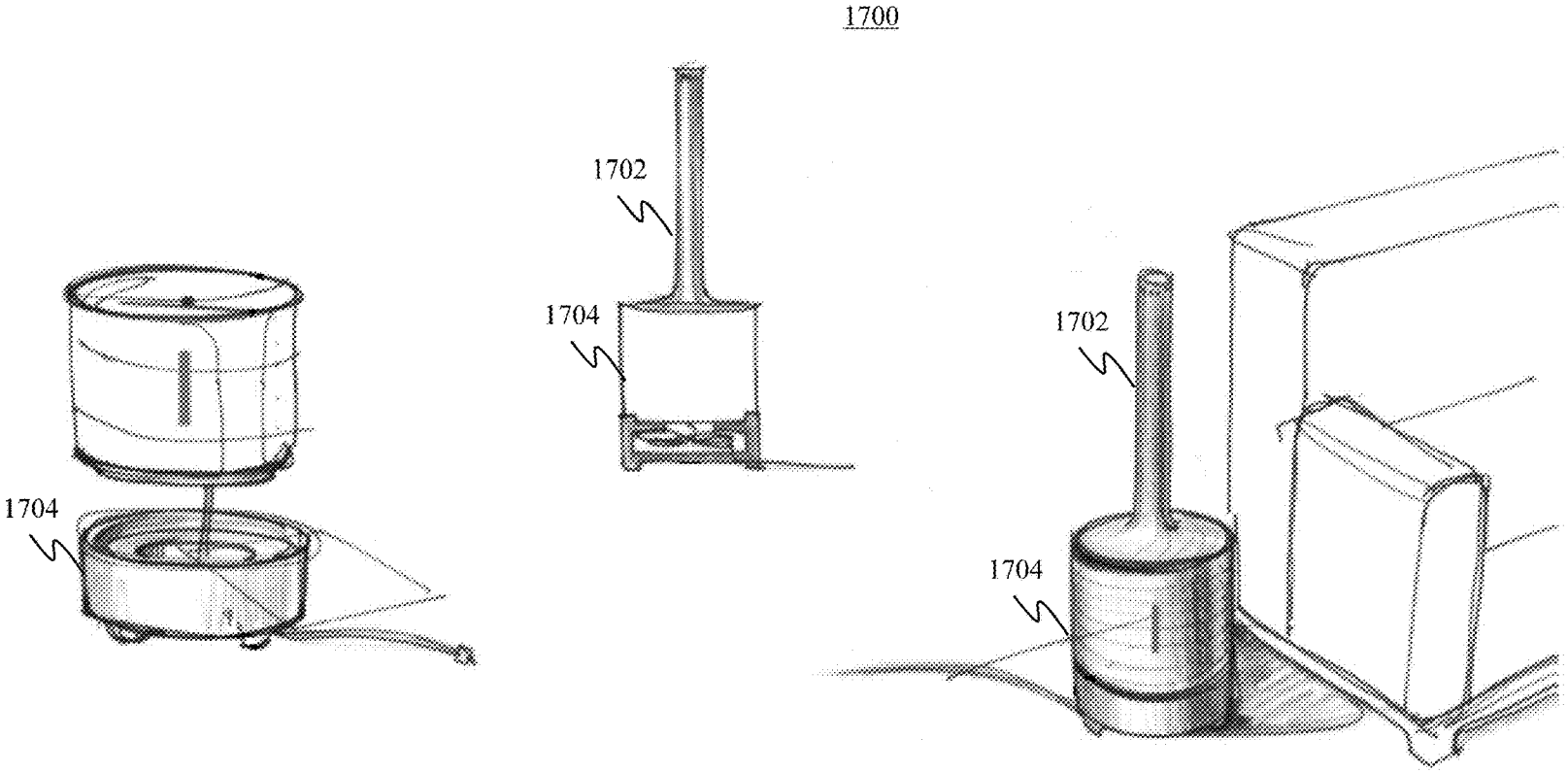
FIG. 17 is a block diagram of another implementation of an example loudspeaker system in accordance with an embodiment.

FIG. 17 depicts a block diagram of another implementation of an example loudspeaker system 1700 in accordance with an embodiment. As shown in FIG. 17, loudspeaker system 1700 includes a loudspeaker 1704 and an extender 1702 that can be optionally connected thereto.

Figure 18:
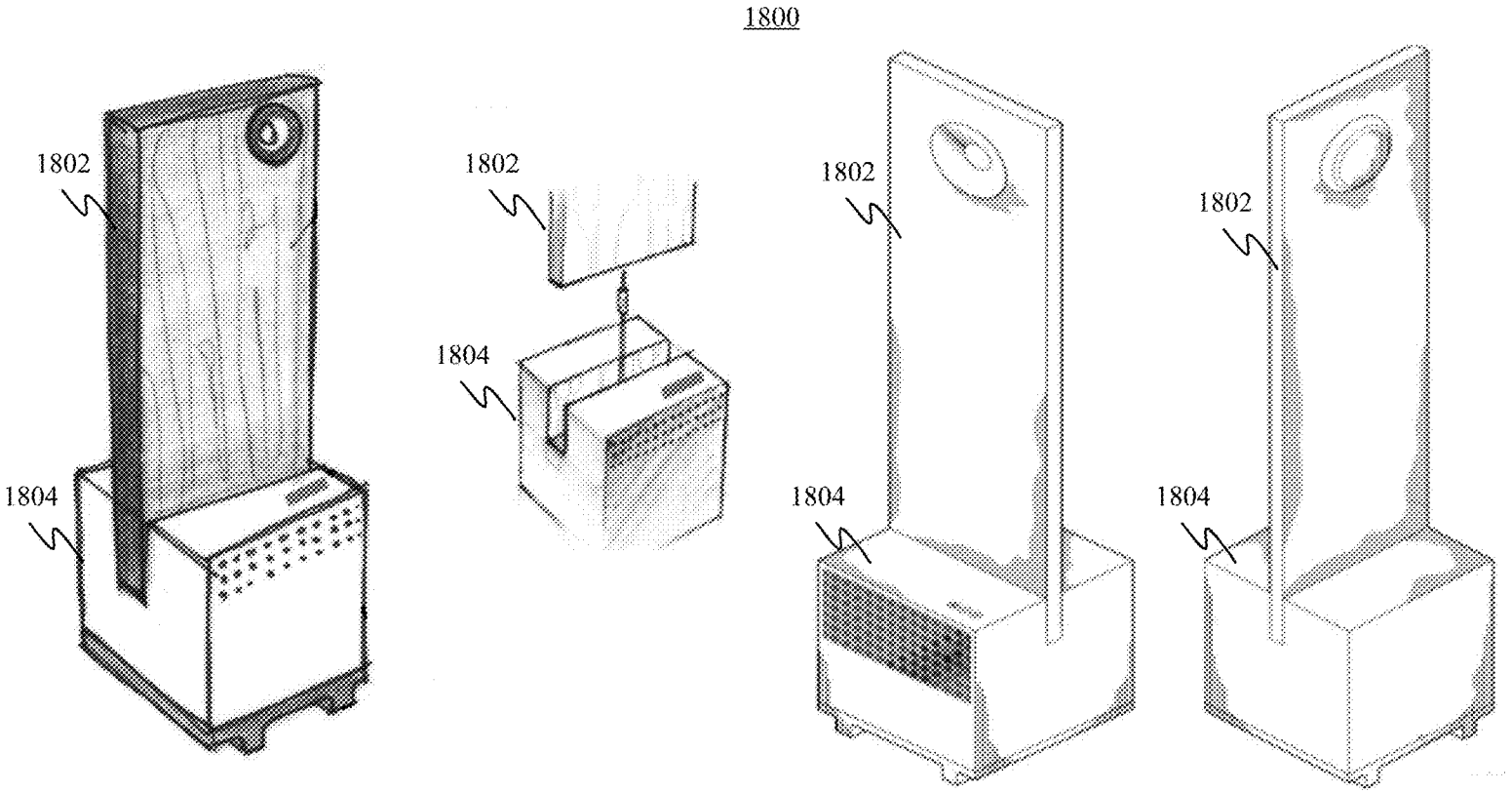
FIG. 18 is a block diagram of another implementation of an example loudspeaker system in accordance with an embodiment.

FIG. 18 depicts a block diagram of another implementation of an example loudspeaker system 1800 in accordance with an embodiment. As shown in FIG. 18, loudspeaker system 1800 includes a loudspeaker 1804 and an extender 1802 that can be optionally connected thereto.

Although in the foregoing description the loudspeaker system is described as including a bookshelf loudspeaker, it is to be understood that the loudspeaker system may include any other type of loudspeaker to which one or more extenders may be optionally attached. That is to say, the embodiments described herein are not limited to bookshelf loudspeakers.

III. Example Computer System Implementation

Various components of above-described loudspeaker system may be implemented in hardware, or any combination of hardware with software and/or firmware. For example, various components of the above-described loudspeaker system may be implemented as computer program code configured to be executed in one or more processors. In another example, various components of the above-described loudspeaker system may be implemented as hardware (e.g., hardware logic/electrical circuitry), or any combination of hardware with software (computer program code configured to be executed in one or more processors or processing devices) and/or firmware.

Figure 14:
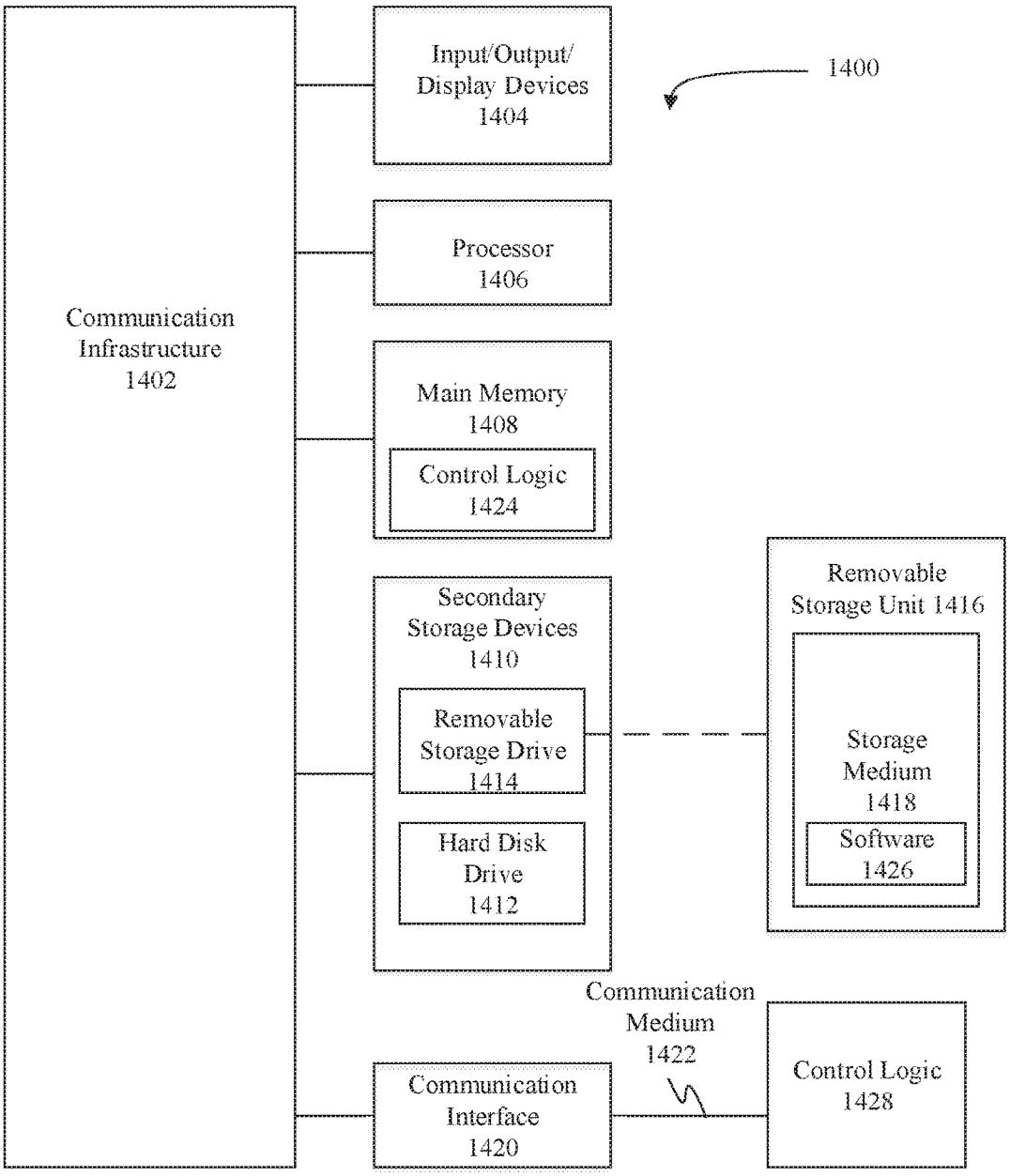
FIG. 14 is a block diagram of an example processor-based system that may be used to implement various embodiments described herein.

The embodiments described herein, including systems, methods/processes, and/or apparatuses, may be implemented using a processor-based computer system, such as system 1400 shown in FIG. 14. For example, various components of the above-described loudspeaker system can each be implemented using one or more systems 1400.

System 1400 can be any commercially available and well known computer capable of performing the functions described herein, such as computers available from International Business Machines, Apple, Sun, HP, Dell, Cray, etc. System 1400 may be any type of computer, including a desktop computer, a server, etc.

As shown in FIG. 14, system 1400 includes one or more processors (also called central processing units, or CPUs), such as a processor 1406. Processor 1406 may be used to implement certain elements of the above-described loudspeaker system; or any portion or combination thereof, for example, though the scope of the embodiments is not limited in this respect. Processor 1406 is connected to a communication infrastructure 1402, such as a communication bus. In some embodiments, processor 1406 can simultaneously operate multiple computing threads.

System 1400 also includes a primary or main memory 1408, such as random access memory (RAM). Main memory 1408 has stored therein control logic 1424 (computer software), and data.

System 1400 also includes one or more secondary storage devices 1410. Secondary storage devices 1410 may include, for example, a hard disk drive 1412 and/or a removable storage device or drive 1414, as well as other types of storage devices, such as memory cards and memory sticks. For instance, system 1400 may include an industry standard interface, such a universal serial bus (USB) interface for interfacing with devices such as a memory stick. Removable storage drive 1414 may represent a floppy disk drive, a magnetic tape drive, a compact disk drive, an optical storage device, tape backup, etc.

Removable storage drive 1414 may interact with a removable storage unit 1416. Removable storage unit 1416 includes a computer useable or readable storage medium 1418 having stored therein computer software 1426 (control logic) and/or data. Removable storage unit 1416 represents a floppy disk, magnetic tape, compact disc (CD), digital versatile disc (DVD), Blu-ray™ disc, optical storage disk, memory stick, memory card, or any other computer data storage device. Removable storage drive 1414 reads from and/or writes to removable storage unit 1416 in a well-known manner.

System 1400 also includes input/output/display devices 1404, such as monitors, keyboards, pointing devices, etc.

System 1400 further includes a communication or network interface 1420. Communication interface 1420 enables system 1400 to communicate with remote devices. For example, communication interface 1420 allows system 1400 to communicate over communication networks or mediums 1422 (representing a form of a computer useable or readable medium), such as local area networks (LANs), wide area networks (WANs), the Internet, etc. Communication interface 1420 may interface with remote sites or networks via wired or wireless connections. Examples of communication interface 1422 include but are not limited to a modem, a network interface card (e.g., an Ethernet card), a communication port, a Personal Computer Memory Card International Association (PCMCIA) card, etc.

Control logic 1428 may be transmitted to and from system 1400 via the communication medium 1422.

Any apparatus or manufacture comprising a computer useable or readable medium having control logic (software) stored therein is referred to herein as a computer program product or program storage device. This includes, but is not limited to, system 1400, main memory 1408, secondary storage devices 1410, and removable storage unit 1416. Such computer program products, having control logic stored therein that, when executed by one or more data processing devices, cause such data processing devices to operate as described herein, represent embodiments of the invention.

Devices in which embodiments may be implemented may include storage, such as storage drives, memory devices, and further types of computer-readable media. Examples of such computer-readable storage media include a hard disk, a removable magnetic disk, a removable optical disk, flash memory cards, digital video disks, random access memories (RAMs), read only memories (ROM), and the like. As used herein, the terms "computer program medium" and "computer-readable medium" are used to generally refer to the hard disk associated with a hard disk drive, a removable magnetic disk, a removable optical disk (e.g., CDROMs, DVDs, etc.), zip disks, tapes, magnetic storage devices, MEMS (micro-electromechanical systems) storage, nanotechnology-based storage devices, as well as other media such as flash memory cards, digital video discs, RAM devices, ROM devices, and the like. Such computer-readable storage media may store program modules that include computer program logic for implementing the elements of the above-described loudspeaker system and/or further embodiments described herein. Embodiments of the invention are directed to computer program products comprising such logic (e.g., in the form of program code, instructions, or software) stored on any computer useable medium. Such program code, when executed in one or more processors, causes a device to operate as described herein.

Note that such computer-readable storage media are distinguished from and non-overlapping with communication media. Communication media embodies computer-readable instructions, data structures, program modules or other data in a modulated data signal such as a carrier wave. The term "modulated data signal" means a signal that has one or more of its characteristics set or changed in such a manner as to encode information in the signal. By way of example, and not limitation, communication media includes wireless media such as acoustic, RF, infrared and other wireless media, as well as wired media. Example embodiments are also directed to such communication media.

It is noted that while FIG. 14 shows a server/computer, persons skilled in the relevant art(s) would understand that embodiments/features described herein could also be implemented using other well-known processor-based computing devices, including but not limited to, smart phones, tablet computers, netbooks, gaming consoles, personal media players, and the like.

IV. Conclusion

While various embodiments have been described above, it should be understood that they have been presented by way of example only, and not limitation. It will be apparent to persons skilled in the relevant art that various changes in form and detail can be made therein without departing from the spirit and scope of the embodiments. Thus, the breadth and scope of the embodiments should not be limited by any of the above-described exemplary embodiments, but should be defined only in accordance with the following claims and their equivalents.

What is claimed is:

1. A loudspeaker system, comprising:

a loudspeaker comprising:

a top surface comprising a first interlocking portion that includes an electrical connector, audio signal processing logic, a low-frequency audio production apparatus, and a first high-frequency audio production apparatus; and an extender that includes a second interlocking portion that may be optionally engaged with the first interlocking portion of the loudspeaker such that the extender is physically supported by the loudspeaker and connected thereto via the electrical connector, the extender comprising a second high-frequency audio production apparatus;

wherein the extender does not require a power source;

wherein the audio signal processing logic includes control logic that is configured to determine whether the extender is connected to the loudspeaker;

wherein the audio signal processing logic is configured to process an input audio signal to produce one or more low-frequency signal components and one or more high-frequency signal components based on a cross-over frequency and to send the one or more low-frequency signal components to the low-frequency audio production apparatus for conversion into low-frequency audio, the cross-over frequency being dynamically and automatically adjustable by the audio signal processing logic based on at least one of a microphone response signal or a current and voltage response of at least one of the loudspeaker and the extender;

wherein the audio signal processing logic is further configured to send at least one of the one or more high-frequency signal components to the first high-frequency audio production apparatus for conversion into high-frequency audio when it is determined that the extender is not connected to the loudspeaker; and wherein the audio signal processing logic is further configured to send at least one of the one or more high-frequency signal components to the second high-frequency audio production apparatus for conversion into high-frequency audio when it is determined that the extender is connected to the loudspeaker.

2. The loudspeaker system of claim 1, wherein the audio signal processing logic further includes a dynamic equalizer, the dynamic equalizer configured to selectively boost or attenuate at least one of the one or more low-frequency signal components and at least one of the one or more high-frequency signal components.

3. The loudspeaker system of claim 2, wherein the dynamic equalizer is configured to selectively boost or reduce the at least one of the one or more low-frequency signal components and at least one of the one or more high-frequency signal components based on one or more of:

a response measured using one or more microphones, each of the one or more microphones being included within or connected to the loudspeaker or the extender; and current and voltage responses of at least one of the loudspeaker and the extender.

4. The loudspeaker system of claim 1, wherein the low-frequency audio production apparatus comprises a sub-woofer, a woofer or a mid-range driver.

5. The loudspeaker system of claim 1, wherein the first high-frequency audio production apparatus or the second high-frequency audio production apparatus comprises a woofer, a mid-range driver, or a tweeter.

6. The loudspeaker system of claim 1 further comprising a second extender that may be optionally connected to the loudspeaker, the second extender comprising a mid-range-frequency audio production apparatus, wherein the audio signal processing logic is further configured to process the input signal to produce one or more mid-range-frequency signal components; and wherein the audio signal processing logic is further configured to send at least one of the one or more mid-range-frequency signal components to the mid-range-frequency audio production apparatus for conversion into mid-range-frequency audio when it is determined that the second extender is connected to the loudspeaker.

7. A method performed by audio signal processing logic of a loudspeaker comprising:

receiving an input audio signal;

processing the input audio signal to produce one or more low-frequency signal components and one or more high-frequency signal components based on a cross-over frequency;

sending the one or more low-frequency signal components to a low-frequency audio production apparatus of the loudspeaker for conversion into low-frequency audio;

determining if an extender is connected to the loudspeaker;

in response to determining that the extender is connected to the loudspeaker, sending at least one of the one or more high-frequency signal components to a high-frequency audio production apparatus of the extender for conversion into high-frequency audio; and in response to determining that the extender is not connected to the loudspeaker, sending at least one of the one or more high-frequency signal components to a high-frequency audio production apparatus of the loudspeaker for conversion into high-frequency audio;

wherein the cross-over frequency is dynamically and automatically adjustable by the audio signal processing logic based on at least one of a microphone response signal or a current and voltage response of at least one of the loudspeaker and the extender; and wherein the loudspeaker comprises a top surface comprising a first interlocking portion that includes an electrical connector and wherein the extender includes a second interlocking portion that may be optionally engaged with the first interlocking portion of the loudspeaker such that the extender is physically supported by the loudspeaker and connected thereto via the electrical connector.

8. The method of claim 7, the method further comprising:

selectively boosting or attenuating at least one of the one or more low-frequency signal components and at least one of the one or more high-frequency signal components.

9. The method of claim 8, wherein the selectively boosting or attenuating at least one of the one or more low-frequency signal components and at least one of the one or more high-frequency signal components comprises selectively boosting or attenuating at least one of the one or more low-frequency signal components and at least one of the one or more high-frequency signal components based on one or more of:

a response measured using one or more microphones, each of the one or more microphones being included within or connected to the loudspeaker or the extender; and current and voltage responses of at least one of the loudspeaker and the extender.

10. The method of claim 7, wherein the low-frequency audio production apparatus comprises a sub-woofer, a woofer or a mid-range driver.

11. The method of claim 7, wherein the high-frequency audio production apparatus of the loudspeaker or the high-frequency audio production apparatus of the extender comprises a woofer, a mid-range driver, or a tweeter.

12. The method of claim 7, the method further comprising, in response to determining that a second extender is connected to the loudspeaker, processing the input audio signal to produce one or more mid-range frequency signal components; and sending at least one of the one or more mid-range frequency signal components to a mid-range-frequency audio production apparatus of the second extender for conversion into mid-range-frequency audio.

13. A computer program product comprising a computer-readable memory device having computer program logic recorded thereon that when executed by at least one processor causes the at least one processor to perform a method, the method comprising:

receiving an input audio signal;

processing the input audio signal to produce one or more low-frequency signal components and one or more high-frequency signal components based on a cross-over frequency;

sending the one or more low-frequency signal components to a low-frequency audio production apparatus of a loudspeaker for conversion into low-frequency audio;

determining if an extender is connected to the loudspeaker;

in response to determining that the extender is connected to the loudspeaker, sending at least one of the one or more high-frequency signal components to a high-frequency audio production apparatus of the extender for conversion into high-frequency audio; and in response to determining that the extender is not connected to the loudspeaker, sending at least one of the one or more high-frequency signal components to a high-frequency audio production apparatus of the loudspeaker for conversion into high-frequency audio;

wherein the cross-over frequency is dynamically and automatically adjustable by the at least one processor based on at least one of a microphone response signal or a current and voltage response of at least one of the loudspeaker and the extender; and wherein the loudspeaker comprises a top surface comprising a first interlocking portion that includes an electrical connector and wherein the extender includes a second interlocking portion that may be optionally engaged with the first interlocking portion of the loudspeaker such that the extender is physically supported by the loudspeaker and connected thereto via the electrical connector.

14. The computer program product of claim 13, the method further comprising:

selectively boosting or attenuating at least one of the one or more low-frequency signal components and at least one of the one or more high-frequency signal components.

15. The computer program product of claim 14, wherein the selectively boosting or attenuating at least one of the one or more low-frequency signal components and at least one of the one or more high-frequency signal components comprises selectively boosting or attenuating at least one of the one or more low-frequency signal components and at least one of the one or more high-frequency signal components based on one or more of:

a response measured using one or more microphones, each of the one or more microphones being included within or connected to the loudspeaker or the extender; and current and voltage responses of at least one of the loudspeaker and the extender.

16. The computer program product of claim 13, wherein the low-frequency audio production apparatus comprises a sub-woofer, a woofer or a mid-range driver.

17. The computer program product of claim 13, wherein the high-frequency audio production apparatus of the loudspeaker or the high-frequency audio production apparatus of the extender comprises a woofer, a mid-range driver, or a tweeter.

18. The computer program product of claim 13, the method further comprising, in response to determining that a second extender is connected to the loudspeaker, processing the input audio signal to produce one or more mid-range frequency signal components; and sending at least one of the one or more mid-range frequency signal components to a mid-range-frequency audio production apparatus of the second extender for conversion into mid-range-frequency audio.

19. The loudspeaker system of claim 1, wherein the extender is configured to physically connect to the loudspeaker in a manner such that when the extender is physically connected to the loudspeaker, the extender is elevated above the loudspeaker.

20. The loudspeaker system of claim 19, wherein when the extender is physically connected to the loudspeaker and the loudspeaker is placed on a floor, the second high-frequency audio production apparatus of the extender is positioned such that it produces the high-frequency audio at or near ear-height of a user.

* * * * *